US007661344B2

(12) United States Patent
Beaudry

(10) Patent No.: US 7,661,344 B2
(45) Date of Patent: Feb. 16, 2010

(54) METHOD AND APPARATUS FOR DIE CUTTING A WEB

(76) Inventor: Wallace J. Beaudry, N9330 County Highway H, Elkhart Lake, WI (US) 53020

( * ) Notice: Subject to any disclaimer, the term of this patent is extended or adjusted under 35 U.S.C. 154(b) by 182 days.

(21) Appl. No.: 10/902,499

(22) Filed: Jul. 29, 2004

(65) Prior Publication Data

US 2005/0067105 A1 Mar. 31, 2005

Related U.S. Application Data

(60) Provisional application No. 60/490,833, filed on Jul. 29, 2003.

(51) Int. Cl.
*B26D 5/20* (2006.01)
*B26D 5/04* (2006.01)
*B41B 1/00* (2006.01)

(52) U.S. Cl. ..... 83/76; 83/298; 83/312; 156/250; 156/256; 156/259; 156/353; 156/510; 156/519

(58) Field of Classification Search ..... 156/353, 156/518, 520, 264, 265, 269, 270, 517, 256, 156/389, 521, 259, 519, 64, 250, 510, 352; 83/168, 922, 76, 298, 312, 363, 369, 76.9, 83/76.7, 370, 911, 74, 403.1, 362; 283/70, 283/75, 94, 346

See application file for complete search history.

(56) References Cited

U.S. PATENT DOCUMENTS 4,255,998 A * 3/1981 Rudszinat ..... 83/298
4,664,736 A * 5/1987 Faasse, Jr. ..... 156/264
4,978,415 A * 12/1990 Jones ..... 156/517
4,994,975 A * 2/1991 Minschart ..... 700/125
5,045,135 A * 9/1991 Meissner et al. ..... 156/64
5,235,515 A * 8/1993 Ungpiyakul et al. ..... 700/125
5,802,974 A * 9/1998 McNeil ..... 101/226
5,899,128 A * 5/1999 Smithe et al. ..... 83/76
5,964,970 A * 10/1999 Woolwine et al. ..... 156/64
6,253,819 B1 7/2001 Frendle et al.
7,021,214 B2 * 4/2006 Kugo et al. ..... 101/485
2003/0188831 A1 * 10/2003 Sasaki et al. ..... 156/510
2003/0234069 A1 * 12/2003 Coenen et al. ..... 156/64
2004/0112517 A1 * 6/2004 Groves et al. ..... 156/264
2005/0092427 A1 * 5/2005 Vergona ..... 156/250

* cited by examiner

*Primary Examiner*—Ghassem Alie
(74) *Attorney, Agent, or Firm*—Ryan Kromholz & Manion S.C.

(57) ABSTRACT

A method and apparatus for producing shaped articles from a web material is disclosed. The apparatus generally includes a rotary cutting roller, preferably including indicia on an end surface, and an anvil roller operating in cooperating rotational movement with the rotary cutting roller. The apparatus die cuts web material into predetermined shapes. The apparatus further includes at least one sensor for detecting rotational movement of the rotary cutting die by way of the indicia on the end surface of the rotary cutting roller. The information from the at least one sensor and an encoder is processed and translated to drive means to thereby corrects variation in web alignment relative to the rotary cutting roller. The adjustment of the rotary cutting roller of the present invention allows the rotary cutting roller to cut within a high degree of accuracy and precision.

39 Claims, 10 Drawing Sheets

METHOD AND APPARATUS FOR DIE CUTTING A WEB

RELATED APPLICATION

This application claims the benefit of U.S. Provisional Patent Application Ser. No. 60/490,833, filed 29 Jul. 2003, and entitled "Method and Apparatus for Die Cutting and Laminating."

BACKGROUND OF THE INVENTION

The present invention relates to a method and an apparatus for die cutting web material into shaped articles, and more particularly to an apparatus that precisely aligns a cutting die relative to the web material to facilitate precise cuts.

In the past, web material including preprinted web material, such as label stock has been laminated and die cut using tools with tolerances of no less than an eighth of an inch. While this level of accuracy is acceptable in certain applications, when relatively small labels or labels having a detailed peripheral edge configuration are desired, a greater degree of cutting accuracy is often desired. Certain tools have used a variety of sensing means configured to read indicia to thereby correctly register the die cuts. While such tools may attain a certain degree of accuracy, the present invention seeks to provide a tool capable of die cutting and laminating a web material with greater cut accuracy while further providing economy of design.

SUMMARY OF THE INVENTION

Briefly, to achieve the desired objects of the instant invention, and in accordance with a preferred embodiment thereof, disclosed herein is an apparatus and method for laminating and die cutting web material. Examples of such web materials may include, but are not limited to blank or printed matter such as labels, gaskets, seals, films, cardboard, and other sheet goods. Users of the apparatus may also choose to die cut web materials without having been previously laminated. Additionally, this invention may be used in conjunction with other tools as for instance a web-printing machine for printing web material on demand and a stacking and folding device (not shown) for preparation of finished product. A perforation die (not shown) may also be included as a feature of the apparatus.

In a preferred embodiment of the present invention, the apparatus includes means for receiving spooled web material, means for receiving laminating material, a rotary cutting die or roller, an anvil roller in cooperating rotational movement with the rotary cutting roller, drive means, at least one idler roller to support the web material preceding a nip between the rotary cutting roller and the anvil roller, an encoder for detecting rotational movement of the anvil roller, at least one end sensor and at least one web sensor, the end sensor detecting at least one indicia on an end surface of the rotary cutting roller, the web sensor for detecting web indicia on the web material, a processor for receiving information from the sensors and encoder and translating the information to the drive means, wherein the drive means preferably includes but is not limited to a stepper motor connected to a differential drive unit, the differential drive unit being connected to the anvil roller, and gearing or other conventional drive means for driving the rotary cutting roller, to thereby correct variation in web alignment relative to the rotary cutting roller. The processor is capable of communicating to the stepper motor, thereby changing the rotational speed of the anvil roller and rotary cutting roller relative the web material to better align predetermined die cutting configurations on the web material. Further, the present invention is adapted to die cut within a high degree of accuracy and precision.

The present invention preferably includes a label supply spindle. The label supply spindle receives spooled, web material for feed into the device of the present invention along the web material path. Alternatively, the present invention may include a web feed assembly adapted to receive preprinted web material from a printing device or other conventional web supply means.

As the web material is unwound from the label supply spindle and following the web material path, or alternatively, supplied by the web feed assembly, it is directed toward a laminating web which is preferably carried on a laminating web supply roll spindle.

The preferred web material to be used in accordance with the present invention is preferably a continuously spooled sheet of a suitable label material that may be carried on a releasable liner material, and having a first side and a second side. The web material may be preprinted or may contain no printing, and supplied in a spindled roll, or may be printed at need by an optionally attached printing system. Further, the web material preferably includes preapplied, longitudinally spaced datum or web indicia marks to be read by the web sensor. The laminating material to be used in accordance with the present invention is preferably a continuously spooled transparent, protective web having an adhesive coated side, although it is within the spirit of this invention to use other types of laminating material such as colored, metallic, or other conventional protective web materials. Alternatively, laminating material may not be used. The laminating material may further include a lamination backing material, if desired. In instances wherein the laminating material is provided with backing material, the apparatus of the present invention may further be supplied with a lamination backing material take-up spindle for receiving backing material after the laminating material has been separated from the backing material.

A method according to the present invention preferably includes the steps of providing a sheet of web material having a first, preprinted side and an oppositely disposed second side along a web material path. One of the first side and the second side of the web material is preferably provided with at least one web indicia. A web sensor is preferably provided for sensing the at least one web indicia mark on the web material.

Next, a rotary cutting roller is provided having a first end surface, a second end surface, and a circumferential surface with at least one indicia on the first end surface and at least one cutting knife on the circumferential surface, the cutting knife corresponding to a predetermined die cutting configuration. The cutting knife extends radially from the circumferential surface to a predetermined height. The rotary cutting roller operates in cooperating rotational movement with an anvil roller. An end sensor is provided for sensing the at least one indicia on the first end surface of the rotary cutting roller. An encoder is also provided for sensing anvil roller rotational movement. The web material is then moved toward a nip between the rotary cutting roller and anvil roller whereby a predetermined die cutting configuration is cut in the laminated web material. A processor receives and processes data from the web sensor, the end sensor, and the encoder and adjusts the rotational movement of the rotary cutting roller to ensure proper placement of the predetermined die cutting configurations.

Additionally, an overdriven lower tension roller and an upper nip roller are preferably provided for receiving the cut web material. The overdriven lower tension roller and the upper nip roller provide a continuous tension on the web material between the overdriven lower tension roller and the upper nip roller and the rotary cutting roller and anvil roller. A take-up spindle may then be provided for receiving a take-up spool, where the take-up spool is arranged to receive cut web material.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention.

Figure 1:
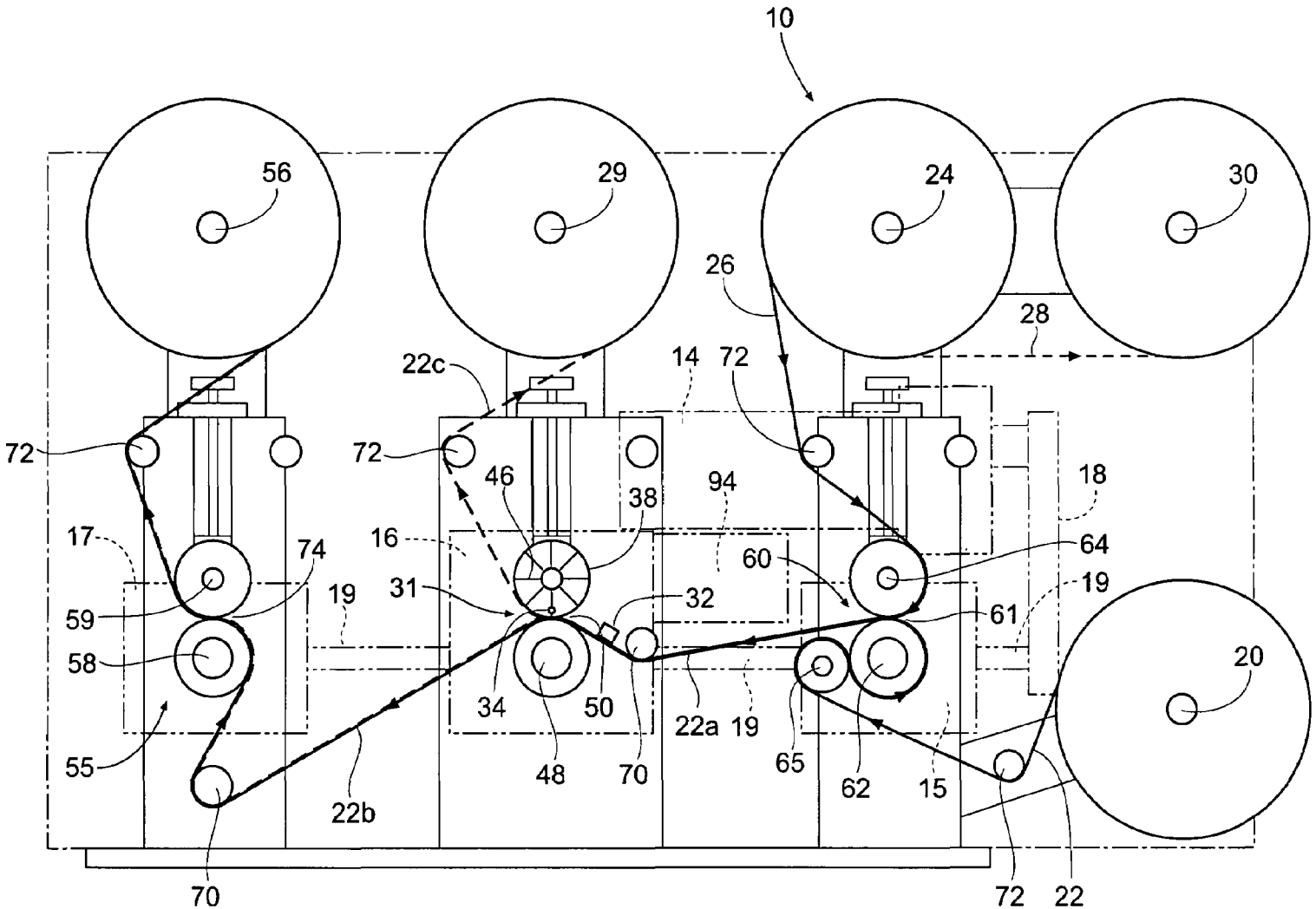
FIG. 1 is a side plan view of an apparatus according to the present invention.
Figure 1A:
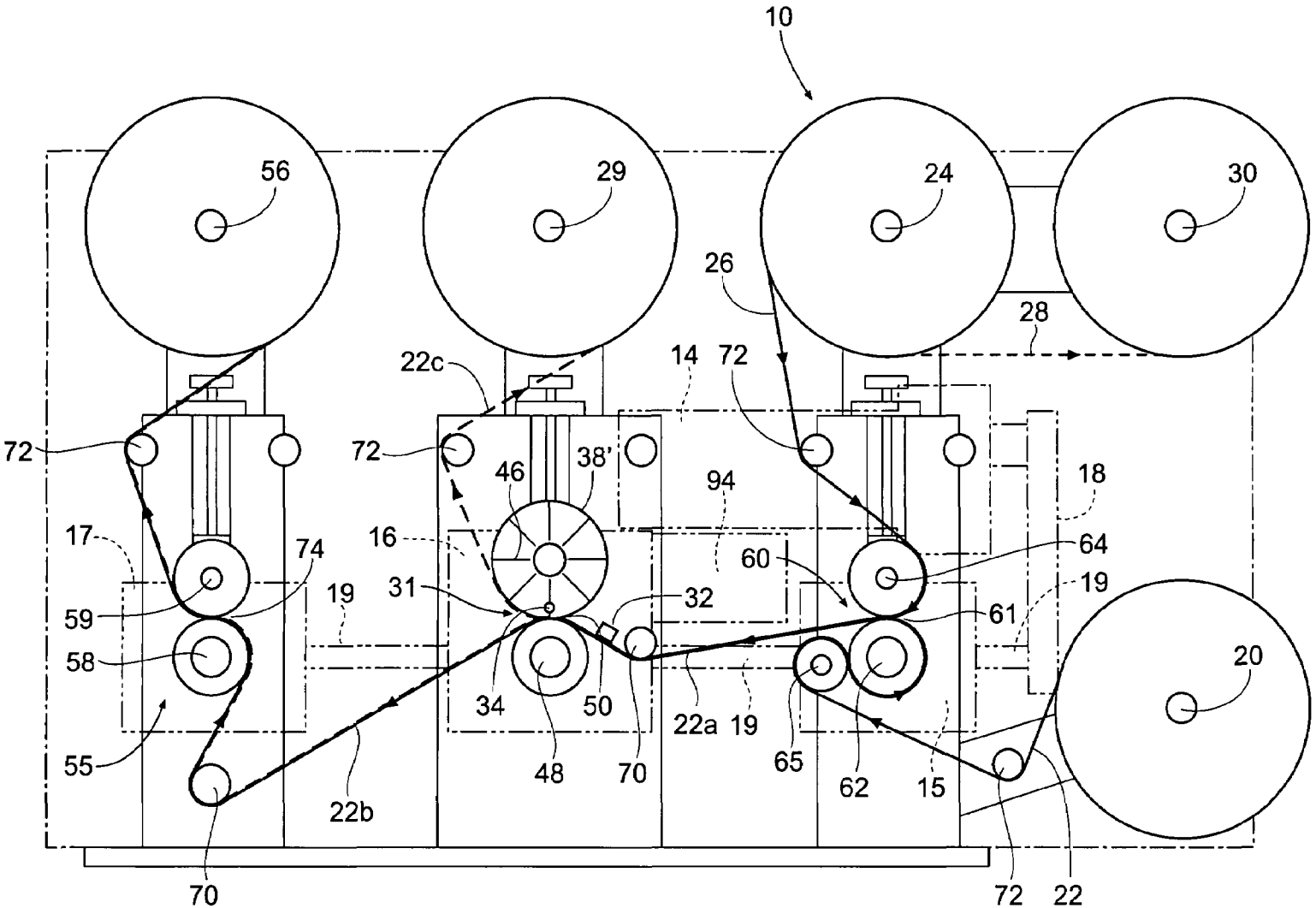
FIG. 1A is a side plan view of an apparatus similar to that of FIG. 1, but showing an alternative rotary cutting roller, having a slightly larger diameter than that illustrated in FIG. 1.
Figure 1B:
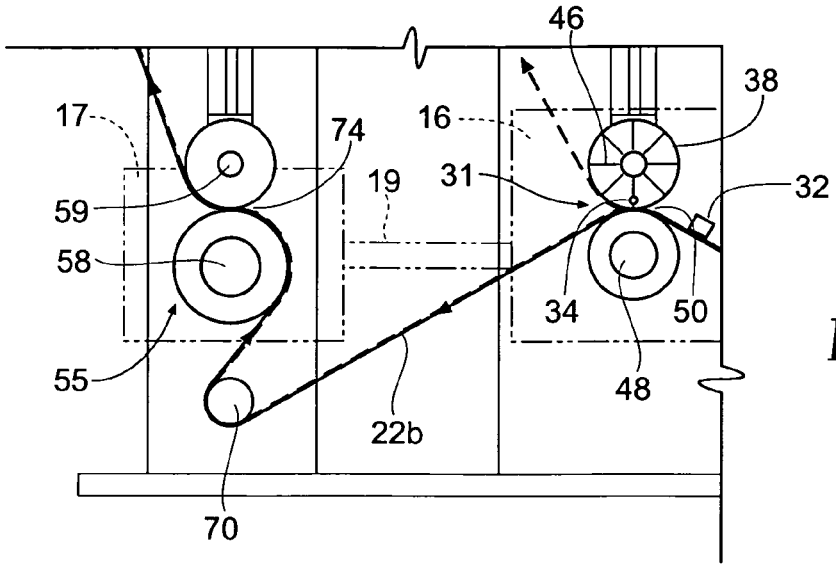
FIG. 1B is a fragmentary, side plan view of an apparatus similar to that of FIGS. 1 and 1A, but showing an alternative overdriven lower tension roller, having a slightly larger diameter than that illustrated in FIGS. 1 and 1A.

Turning now to the drawings, in which like reference numerals refer to corresponding elements throughout the views, attention is first directed to FIG. 1 illustrating a side plan view of the apparatus 10 with the control panel (not shown) removed so that the various components of the apparatus 10 may be better seen.

The apparatus 10 preferably includes a web feed spindle 20 for carrying spooled, continuous, preprinted web material 22 of the type to be used with the present invention, and a laminating spindle 24 for receiving spooled laminating material 26 of the type to be used with the present invention. As may be seen particularly in FIG. 1, a stepper motor 94 is preferably arranged to provide power to differential drive 16 (shown in phantom in these views). Gearboxes 15, 17 are engaged to the differential drive 16 by way of shaft 19 (shown in phantom). A drive motor 14 is preferably arranged to provide power to drive belt 18 (shown in phantom), which engages shaft 19.

As best seen in FIGS. 7A through 7D, web material 22, is generally described as preferably having a first side 25 and an oppositely disposed second side 27. The web material 22 preferably includes a releasable liner material 21 located adjacent the second side 27. Web material 22 preferably includes an adhesive (not shown) on the second side 27. It is to be understood that web material 22 does not require the releasable liner material 21. Web material 22 preferably is adapted to include preapplied longitudinally spaced web indicia 12. The web feed spindle 20 is arranged to facilitate web material 22 feed into the apparatus 10.

Figure 8A:
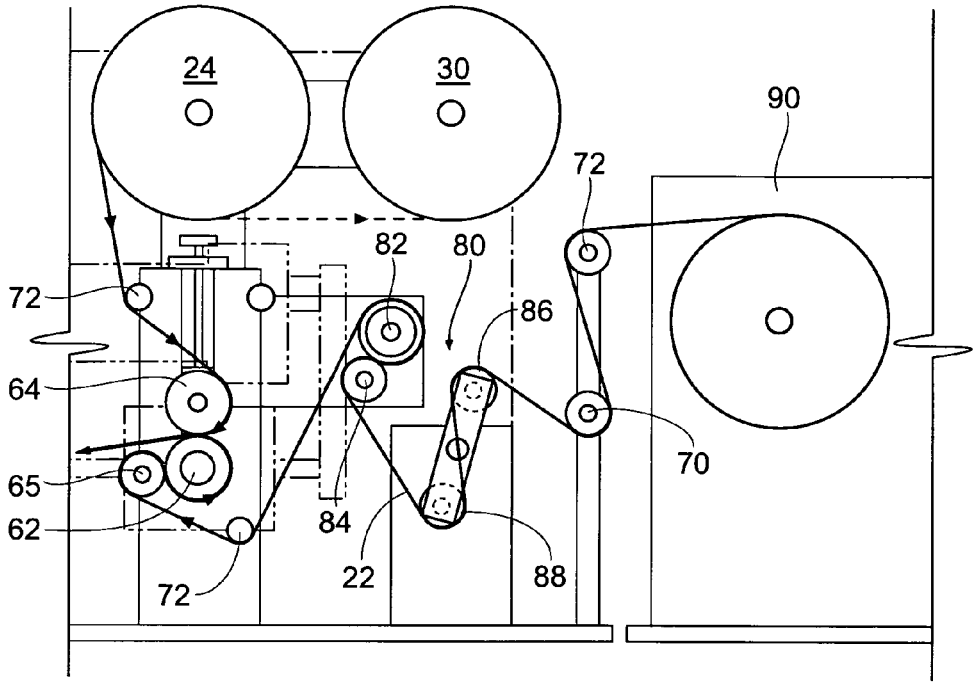
FIG. 8A is a side plan view of an alternative web feed assembly, showing the upper and lower rocker rollers in a first predetermined position.
Figure 8B:
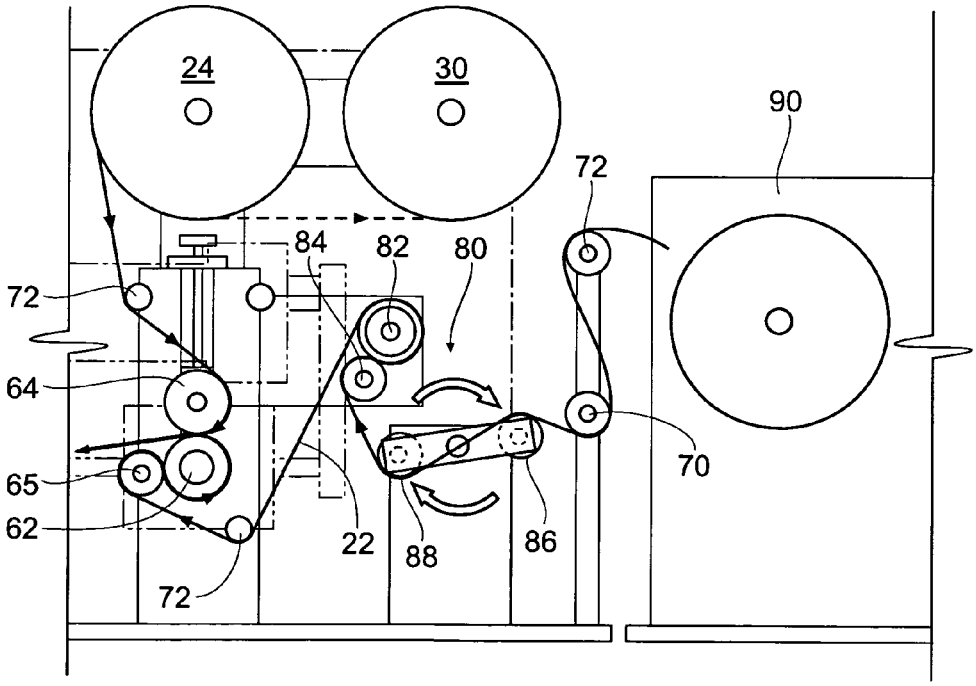
FIG. 8B is a side plan view of the alternative web feed assembly of FIG. 8A showing the upper and lower rocker rollers in a second predetermined position.

Referring to FIGS. 8A and 8B, alternatively, the apparatus 10 may include a web feed assembly 80. The web feed assembly 80 preferably includes a clutched roller 82 and a wrap idler 84, and allows the apparatus 10 to receive preprinted web material 22 from a printer 90 or other conventional web supply means. The web feed assembly 80 further preferably includes an upper rocker roller 86 and a lower rocker roller 88 adapted to shut off the apparatus 10 when the printer 90 or other web supply means stops providing preprinted web material 22. As can be seen in FIG. 8B, the upper and lower rocker rollers 86, 88 may rotate in the direction shown to a predetermined position when web material 22 no longer provides sufficient tension to maintain the upper and lower rocker rollers 86, 88 in a first predetermined position as seen in FIG. 8A. When the upper and lower rocker rollers 86, 88 rotate, a switch (not shown) may be activated to remove power to the apparatus 10.

Referring to FIG. 1, the laminating material 26 may include a backing material 28, with backing material take-up spindle 30 being arranged to receive and wind up backing material 28 once the laminating material 26 has been removed. Alternatively, the laminating material 26 may be an adhesive-backed material without backing material.

Figure 2:
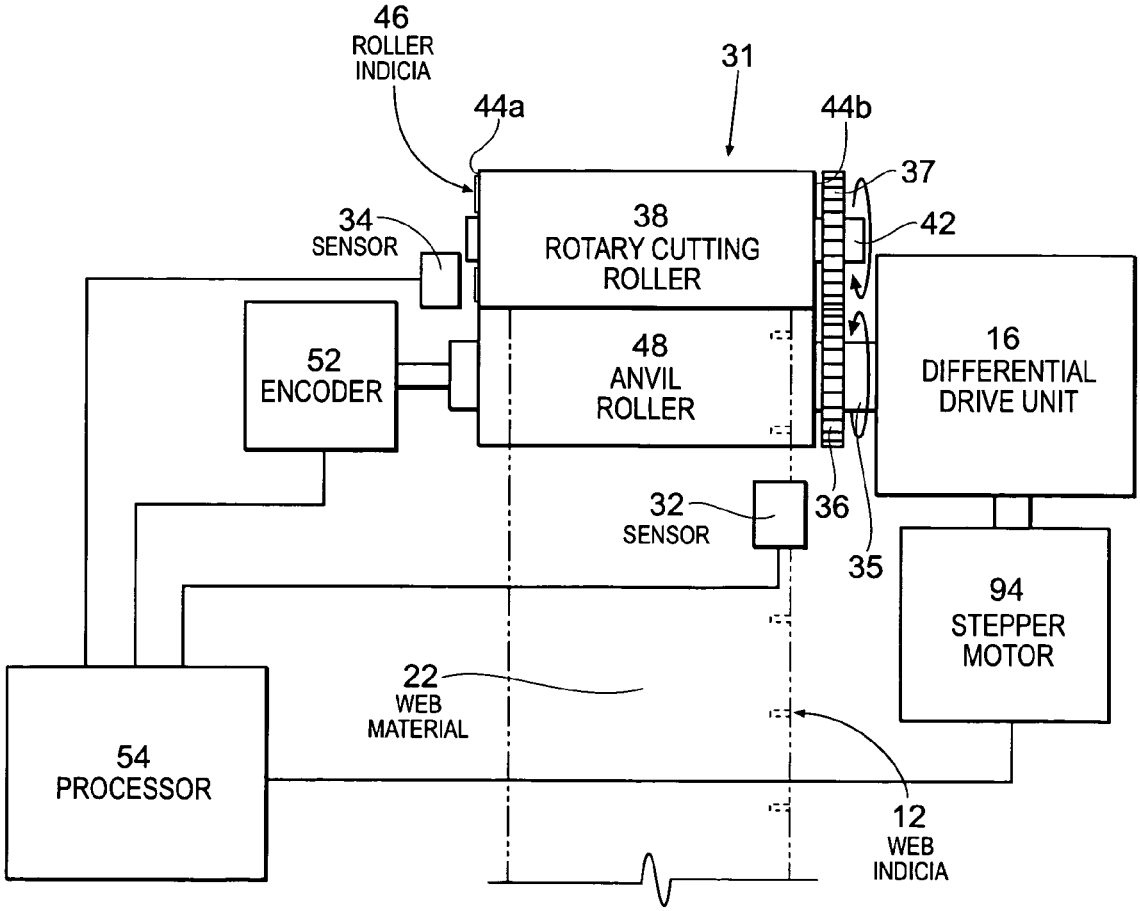
FIG. 2 is a schematic view illustrating the general relationship of the rotary cutting roller, anvil roller, sensing devices, and rotary cutting roller driving means.
Figure 3:
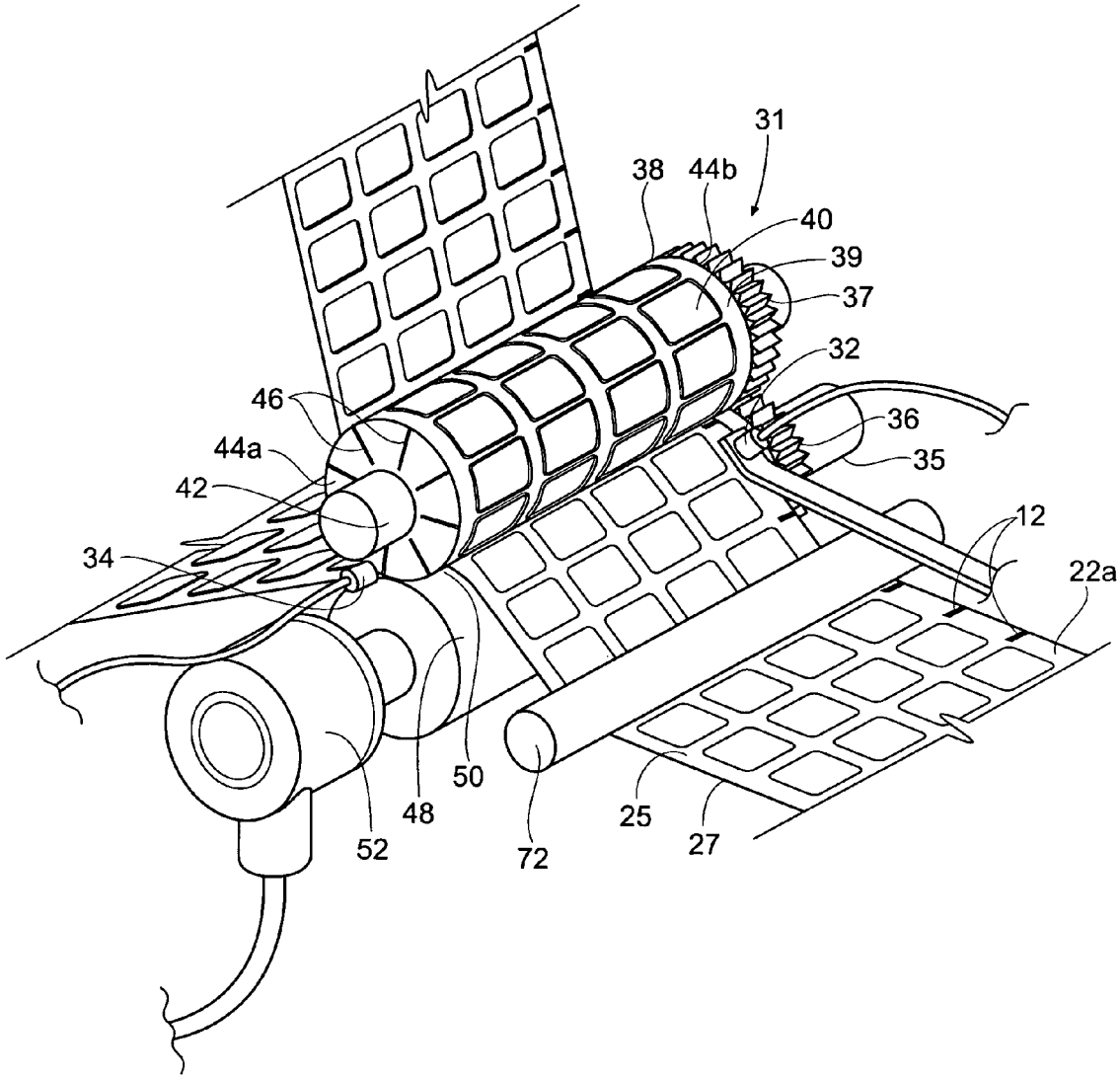
FIG. 3 is a perspective view of a rotary cutting roller and anvil roller with sensors and encoder according to the present invention.
Figure 4A:
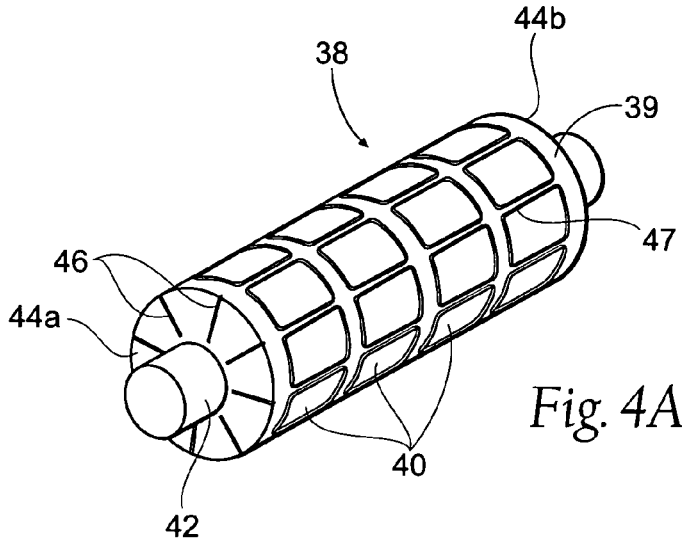
FIGS. 4A-4C are perspective views of rotary cutting rollers according to the present invention and showing indicia on a first end surface thereof.
Figure 4B:
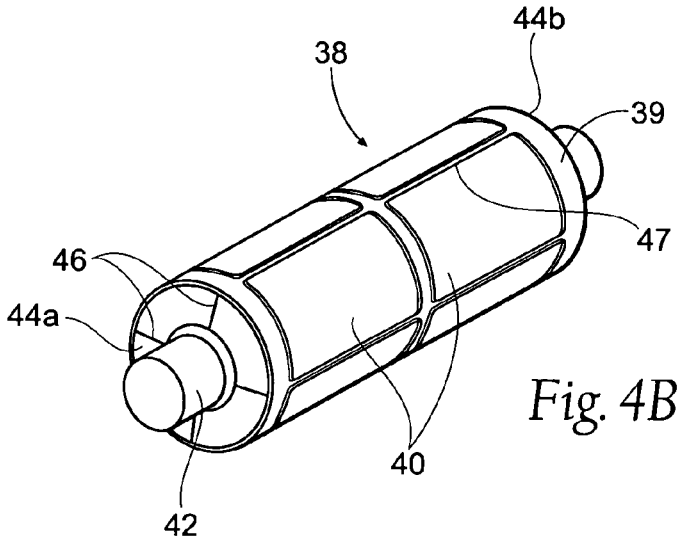
Figure 4C:
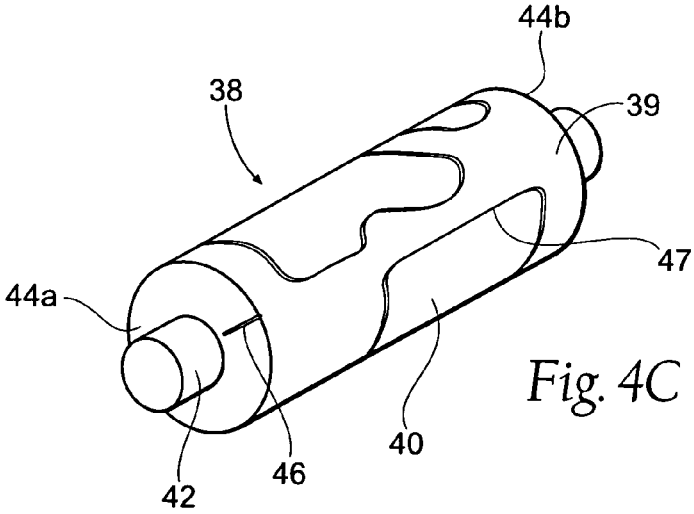

As further seen in the Figures and particularly FIGS. 2 and 3, the present invention further includes a novel rotary cutting assembly 31. The rotary cutting assembly 31 is adapted to receive laminated web material 22*a* for die cutting. As seen, the cutting assembly 31 preferably includes a rotary cutting roller 38 having at least one cutting knife or edge 40 located on its circumferential surface 39. The cutting knife 40 has a predetermined die cutting configuration corresponding to the cut desired. The cutting knife 40 extends radially from the circumferential surface to a predetermined height H (see FIG. 7C), allowing the cutting knife 40 to cut a range of layers of the web material 22, in a variety of applications, ranging from all the web layers to none of the web layers. It is to be noted that any number or shape of cutting knifes 40 may be used, including open ended, such as a line or zig-zag pattern, or closed configurations as seen for example in FIGS. 4A-4C. As may be further seen in FIGS. 3 and 4A-4C, the rotary cutting roller 38 preferably includes a central shaft 42 and a first end surface 44*a* and a second end surface 44*b*. First end surface 44*a* preferably includes at least one indicia 46. Indicia 46 may be engraved or attached on first end surface 44*a* or alternatively, may be printed on paper or other suitable material and affixed to first end surface 44*a* as seen in FIG. 4B. The preferred method of applying indicia 46 to the first end surface 44*a* is engraving to minimize the tendency of alternative applications to shift or fall off over time. As seen particularly in FIG. 4A-4C, the number and placement of indicia 46 may correspond to the number and placement of repeat cutting knifes 40. For example, FIG. 4B illustrates a rotary cutting roller 38 having four repeat rows of cutting knifes 40, with four indicia marks 46 corresponding to a first edge 47 of each row, although it is to be understood that the indicia 46 may correspond to any predetermined location of the rotary cutting roller 38.

As seen in FIGS. 2 and 3, the rotary cutting assembly 31 preferably further includes an end sensor 34. The end sensor 34 is adapted to detect the indicia pattern 46 on the preferred first end surface 44*a* as the rotary cutting roller 38 rotates on shaft 42. This arrangement is preferred over known arrangements, which are typically arranged to detect markings on circumferential surfaces. Sensors in known arrangements must be moved relative to every cutting roller diameter. The present novel arrangement allows the end sensor 34 to be fixed and able to read indicia 46 on rotary cutting roller 38 regardless of the diameter of rotary cutting roller 38. As can be seen in FIG. 1, and by way of non-limiting example, a rotary cutting roller 38' is shown in dashed lines, with a diameter greater than that of rotary cutting roller 38. The positioning of end sensor 34 is unaffected by the change in diameter from rotary cutting roller 38 to rotary cutting roller 38'. End sensor 34 remains in position to detect the indicia 46 on end surface 44*a* as the rotary cutting roller 38 or 38' rotates on shaft 42.

As may be seen particularly in the view of FIG. 3, the rotary cutting assembly 31 further preferably includes a web indicia sensor 32, which is adapted to detect web indicia 12 on the web material 22*a* as it advances toward the rotary cutting roller 38. The rotary cutting assembly 31 further includes an anvil roller 48 in cooperating rotational movement with the rotary cutting roller 38. The rotary cutting roller 38 and the anvil roller 48 being in rotational contact to provide a nip 50 to receive laminated web material 22*a*. The rotary cutting roller 38 and anvil roller 48 rotate in opposite directions such that the web material 22*a* is drawn into the nip 50 upon contact with the rotary cutting roller 38. Preferably, the rotary cutting roller 38 is configured to substantially the height needed to cut the web material 22*a* without cutting the releasable liner material 21 (see FIGS. 7A through 7D and FIG. 10), although it is to be understood that the cutting knife 40 may be of any predetermined height H necessary to cut as many layers of a web material as required by the user.

As may be further seen in FIGS. 2 and 3, the rotary cutting assembly 31 further preferably includes an encoder 52. Encoder 52 is coupled to the anvil roller 48 and detects incremental rotational movement of the anvil roller 48. The encoder 52, along with web sensor 32 and end sensor 34 are further in communicative arrangement with processor 54 (see schematic view of FIG. 2). The processor 54 is preferably in communication with the stepper motor 94. The stepper motor 94 allows adjustment in rotational speed of the anvil roller 48 and rotary cutting roller 38 thereby maintaining alignment of the rotary cutting roller 38 relative to the web material 22*a* to be cut.

As seen in FIG. 1, the apparatus 10 of the present invention further preferably includes an infeed and laminating assembly 60 for applying the laminating material 26 to the preprinted web 22. As seen, the infeed and laminating assembly 60 preferably includes a drive roller 62 and a pressure roller 64. The infeed and laminating assembly 60 further may include drive means such as a gear box 15 or other conventional means for controlling rotational movement of the drive roller 62, along with a tension roller 65 adapted to maintain tension on the preprinted web material 22 prior to applying the laminating material 26. Preceding the tension roller 65 may be a guide roller 72 to guide the web material 22 into the infeed and laminating assembly 60.

Figure 5:
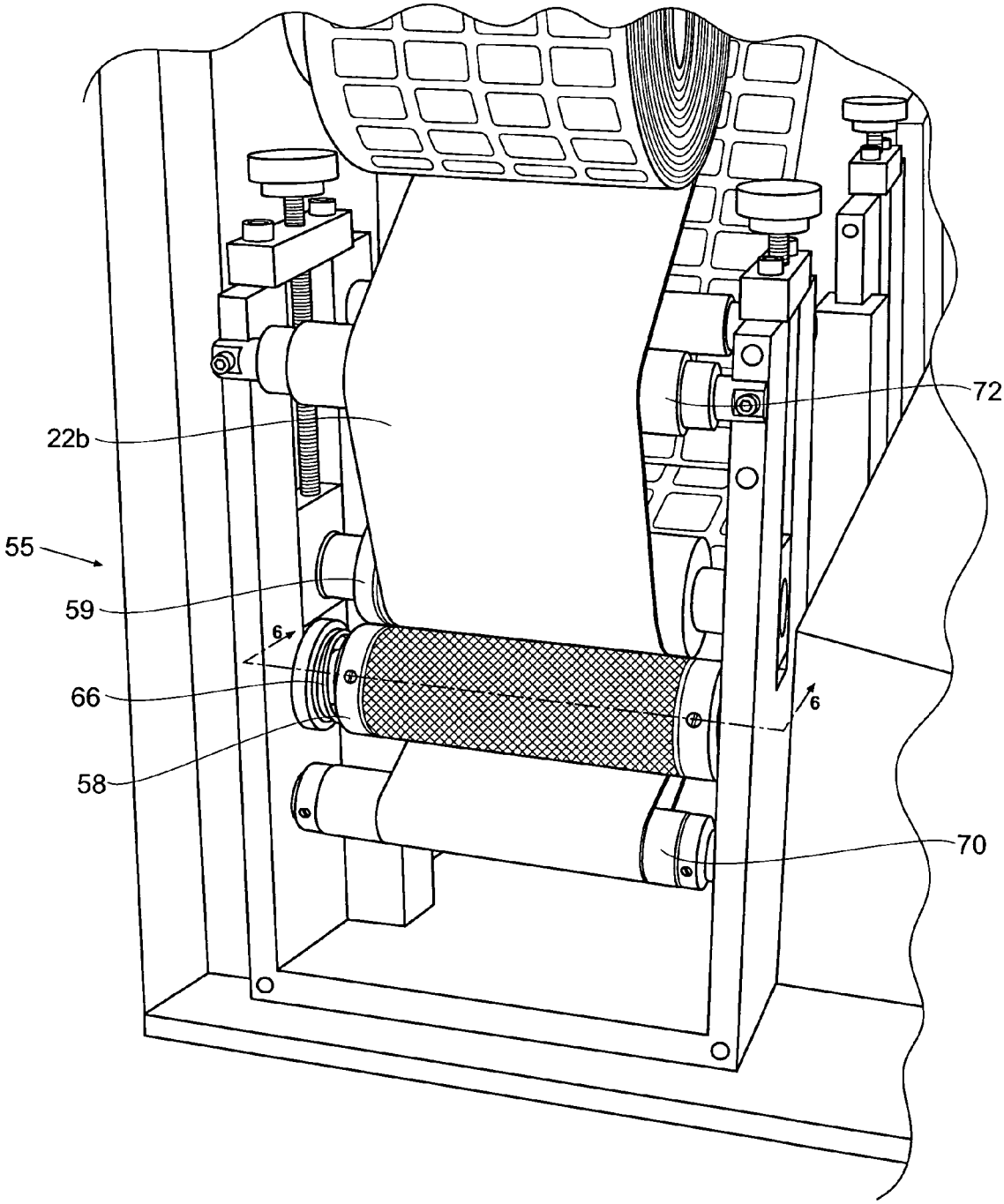
FIG. 5 is a fragmentary end view of the apparatus of the present invention and showing cut, laminated web material in relation to the upper nip roller and overdriven lower tension roller.
Figure 6:
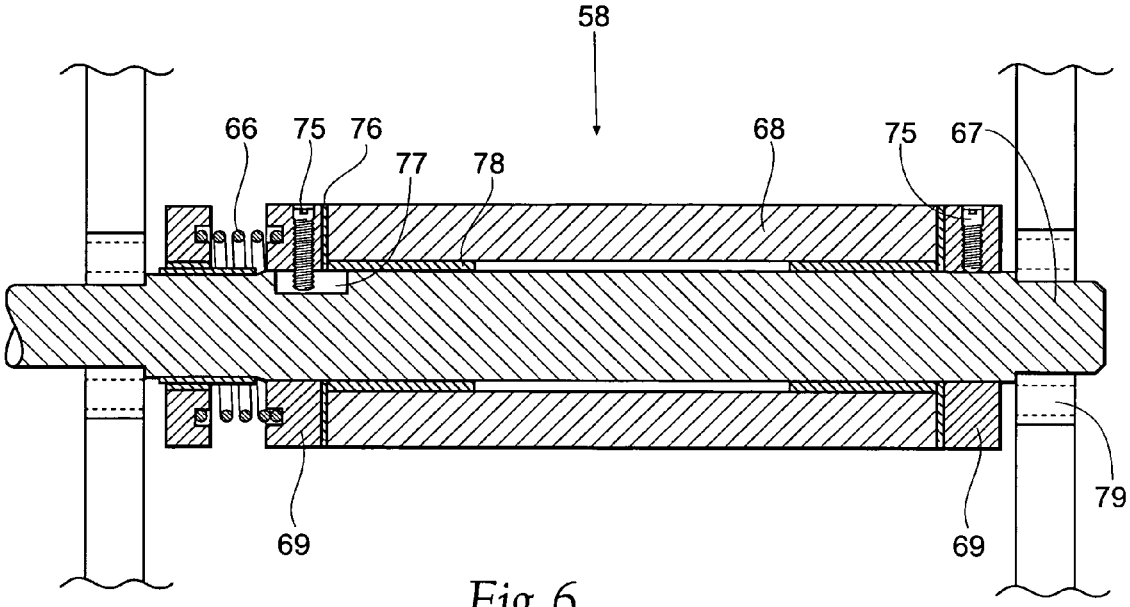
FIG. 6 is a sectional view of the overdriven lower tension roller shown in FIG. 5, and taken along lines 6-6 thereof.
Figure 7A:
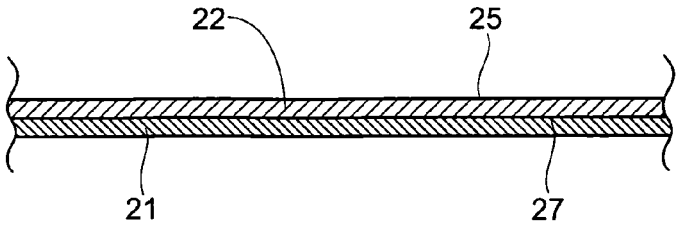
FIG. 7A is a partial side plan view of the preferred web material as shown in FIG. 9.
Figure 7B:
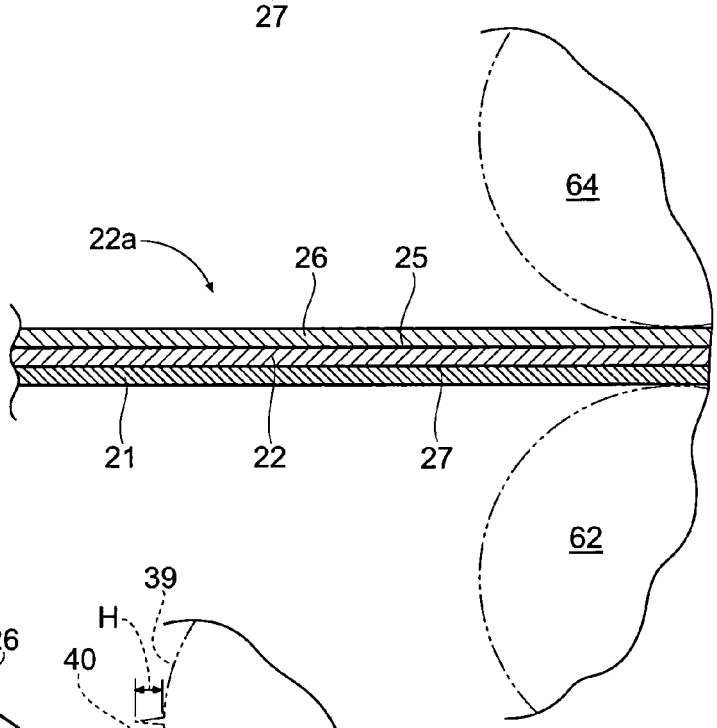
FIG. 7B is a partial side plan view of the web material of FIG. 7A, including a laminating layer, as shown in FIG. 9.
Figure 7C:
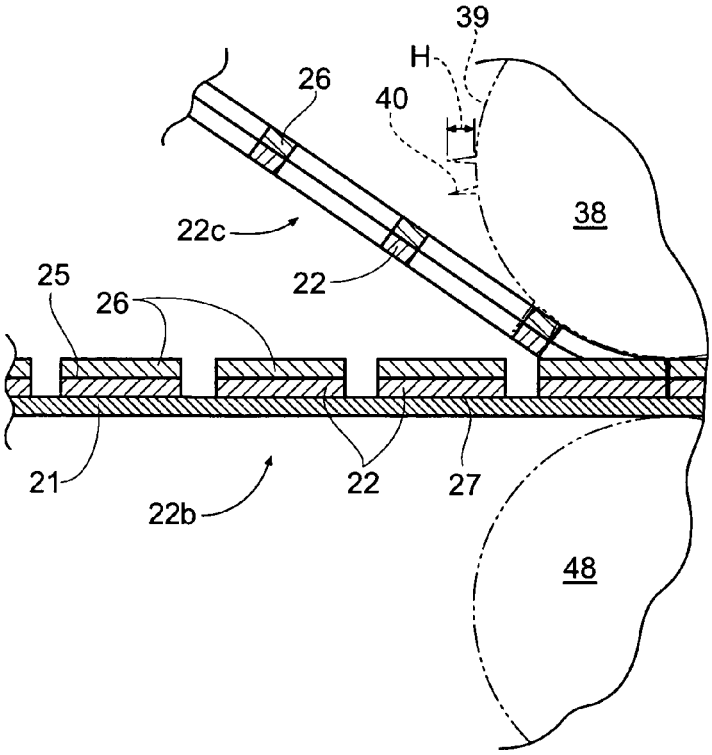
FIG. 7C is a partial side plan view of the laminated web material of FIG. 7B, showing the excess laminating material and web material removed after the die cutting process, as shown in FIG. 10.
Figure 7D:
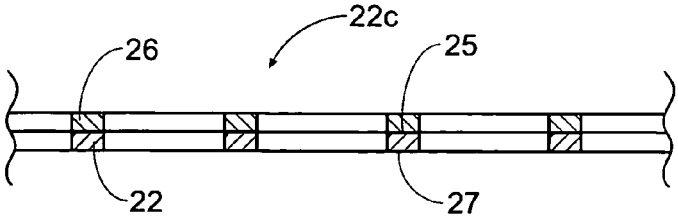
FIG. 7D is a partial side plan view of the excess laminating material and web material of FIG. 7B, as shown in FIG. 10.

As seen in FIGS. 1 and 5, the apparatus 10 of the present invention further preferably includes a take-up assembly 55 for taking up cut web material 22*b* and maintaining proper tension of the web material 22*b* throughout its travel from the rotary cutting assembly 31. The take-up assembly 55 preferably includes a take-up spindle 56 for receiving spooled cut web material 22*b*, an overdriven lower tension roller 58, an upper nip roller 59, and drive means such as a gearbox 17 or other conventional means for controlling rotational movement of the overdriven lower tension roller 58. An idler roller 70 may support the web material 22*b* preceding a nip 74 between the overdriven lower tension roller 58 and the upper nip roller 59. Preceding the take-up spindle 56 may be a guide roller 72 to guide the web material 22*b* onto the take-up spindle 56. Alternatively, laminated and cut web material 22*b* may be fed into a folding and stacking apparatus (not shown) or other conventional post laminating and cutting operation. The tension roller 58 is preferably of a larger diameter than the anvil roller 48 thereby creating proper tensioning of the cut web material 22*b* between the anvil roller 48 and the tension roller 58. The overdriven lower tension roller 58 is further adapted to slip a predetermined amount with every revolution. As seen particularly in FIG. 6, rotational slippage of the tension roller 58 is controlled due to end pressure exerted by spring biasing means 66, wherein the spring biasing means 66 is preferably a helical spring. The tension roller 58 is further provided with a shaft 62 having a sleeve 68 circumjacent to the shaft 62, the shaft being supported by bearings 79. The tension roller 58 preferably includes laterally spaced oppositely disposed end caps 69 mating with respective ends of the sleeve 68, with oil washers 76 positioned therebetween. End caps 69 may be secured by way of conventional means such as the set screws 75 shown, and positioned within at least one key way 77. A bushing 78 may also be positioned between the sleeve 68 and the shaft 62.

As seen in FIGS. 1 and 7A through 7D, spooled web material 22 may be threaded through the apparatus 10 prior to commencement of the laminating and cutting processes. The preprinted web material 22 is positioned in the apparatus 10 such that it is guided by guide roller 72 and tension roller 65 into nip 61 formed between drive roller 62 and pressure roller 64, wherein if desired laminating material 26 may be applied to the web material 22. Thereafter, the laminating material 26 having been applied to the web material 22, the laminated web material 22*a* continues past idler roller 70 and sensor 32 and into nip 50. The nip 50 is preferably provided by the anvil roller 48 and rotary cutting roller 38. As mentioned previously, the anvil roller 48 is preferably driven by differential drive motor 16 by way of stepper motor 94. The anvil roller 48 and rotary cutting roller 38 are designed to pull the laminated web material 22*a* through the nip 50 for cutting. Excess laminated web material 22*c* continues past guide roller 72 and is preferably received onto a take-up spindle 29. Laminated and cut web material 22*b* proceeds towards take-up assembly 55 and continues past idler roller 70 and into nip 74. The nip 74 is preferably provided by the overdriven lower tension roller 58 and upper nip roller 59. Laminated and cut web material 22*b* preferably continues through nip 74 and past guide roller 72, and may be received on take up spindle 56.

Referring to FIGS. 8A and 8B, alternatively, the preprinted web material 22 may be positioned in the apparatus 10 such that it is first positioned in the web feed assembly 80. As may be seen particularly in FIG. 8A, web material 22 may be supplied by a printer 90 or other conventional web producing means. The preprinted web material 22 may be guided by guide roller 72 and idler roller 70 of the web feed assembly 80. The web material 22 may then be guided by upper rocker roller 86 and lower rocker roller 88. Preferably, the web material 22 is next fed between a wrap idler 84 and a clutched roller 82 in order to supply properly tensioned web material 22 to the apparatus 10.

The upper rocker roller 86 and the lower rocker roller 88 preferably function as a power switch to apparatus 10. When web material 22 is present within the web feed assembly 80, as seen in FIG. 8A, the upper and lower rocker rollers 86, 88 are maintained in a predetermined position as shown, and power may be allowed to the apparatus 10. When web material 22 is no longer supplied to the web feed assembly 80 and tension from web material 22 is no longer applied to the upper and lower roller rockers 86, 88, the roller rockers 86, 88 may rotate and take on a position as shown in FIG. 8B. In this position, power may be disconnected to the apparatus 10 by way of a switch (not shown).

Referring to FIGS. 1 and 3, as earlier mentioned, the laminated web material 22*a* is pulled through the apparatus 10 and past web sensor 32. The web material 22*a* preferably includes web indicia 12. The web sensor 32 is arranged to detect the web indicia 12 so that the apparatus 10 may determine presence and incremental movement of the laminated web material 22*a* as it advances toward the nip 50. Additionally, end sensor 34 determines the rotational speed of the rotary cutting roller 38 to thereby allow precise cut alignment. As seen in FIG. 2, in order to achieve precision cuts, the web sensor 32 and the end sensor 34, along with the encoder 52, are preferably connected to the processor 54, which adjusts the speed of the rotary cutting roller 38 and anvil roller 48 via stepper motor 94 connected to the differential drive unit 16.

Figure 9:
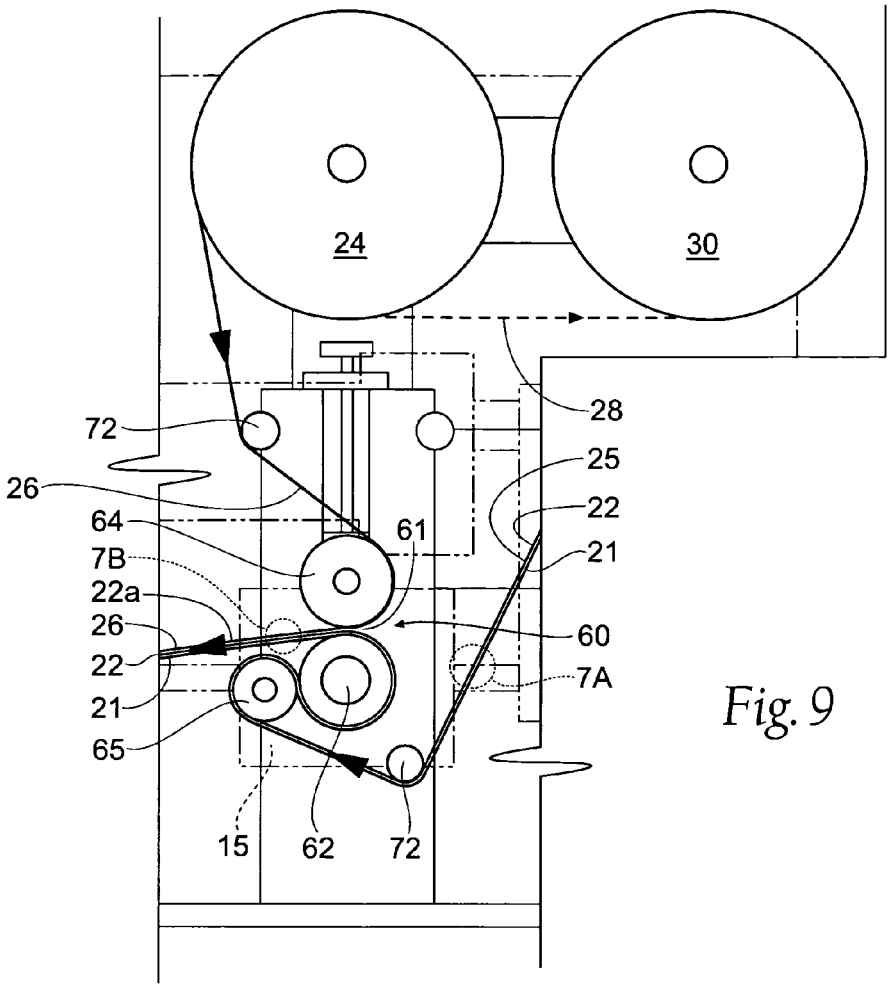
FIG. 9 is a side plan view of the infeed and laminating assembly of the apparatus of FIG. 1.
Figure 10:
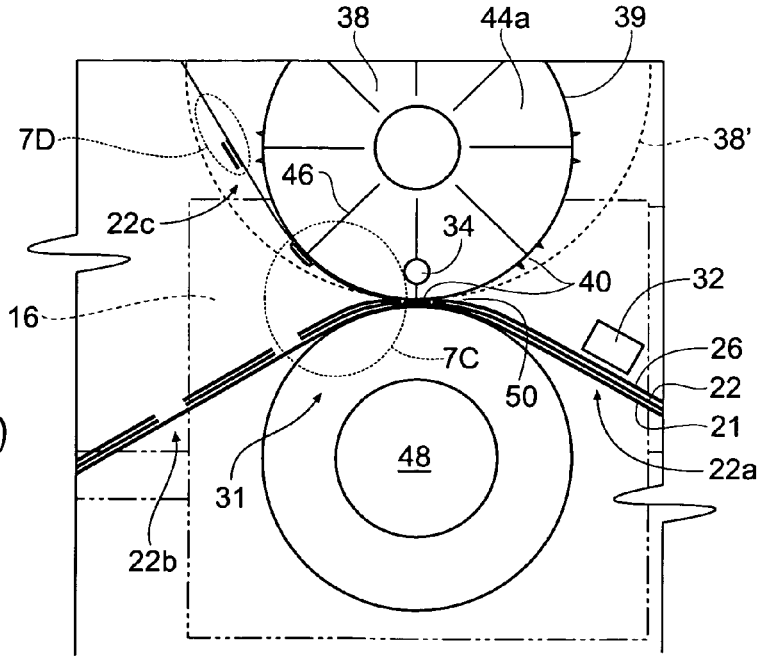
FIG. 10 is a detailed side plan view of the rotary cutting assembly of the apparatus of FIG. 1.

Additionally, the present invention may be described as a method for die cutting and laminating. The steps of the method of die cutting and laminating according to the present invention are generally described. Referring generally to the Figures, and specifically to FIGS. 3 and 9, a web material 22 having a first preprinted side 25 and an oppositely disposed second side 27 is provided to the apparatus 10 along a web material path and toward previously described infeed and laminating assembly 60. One of the first side 25 and the second side 27 of the web material 22 may be provided with at least one web indicia 12. A drive roller 62 and pressure roller 64 are provided and operate in cooperating rotational movement, the drive roller 62 preferably being driven by a gear box 15 for controlling rotational movement. A tension roller 65 is positioned for tensioning web material 22 preceding a nip 61 formed between the drive roller 62 and pressure roller 64. A laminating spindle 24 is provided for receiving spooled laminating material 26 of the type to be used with the present invention. A laminating material 26 preferably is next provided to the nip 61 formed between the drive roller 62 and pressure roller 64. The laminating material 26 is preferably provided having an adhesive coated side. The adhesive coated side of the laminating material 26 is applied to the first side 25 of the web material 22 whereby a laminated web material 22*a* is formed.

Referring to FIGS. 1 and 3, a web sensor 32 is provided for sensing the at least one web indicia 12 on the web material 22*a*. The laminated web material 22*a* is then moved past the web sensor 32. Next, a rotary cutting roller 38 is provided having a first end surface 44*a*, a second end surface 44*b*, and a circumferential surface 39, with at least one indicia 46 on the first end surface 44*a* and at least one cutting knife 40 on the circumferential surface 39, corresponding to a predetermined die cut configuration. The rotary cutting roller 38 operates in cooperating rotational movement with an anvil roller 48. An end sensor 34 is preferably provided for sensing the at least one indicia 46 on the first end surface 44*a* of the rotary cutting roller 38. An encoder 52 is also preferably provided for sensing anvil roller 48 rotational movement. The web material 22*a* is then moved toward a nip 50 between the rotary cutting roller 38 and anvil roller 48 whereby a die cutting configuration is cut in the laminated web material 22*b*. The anvil roller 48 is preferably provided with a differential drive unit 16 controlled by a stepper motor 94, and further including a drive means such as a belt, shaft, or gear 36 for interfacing with the rotary cutting roller 38. The rotary cutting roller 38 is also further provided with a drive means such as a belt, shaft, or gear 37 for interfacing with the anvil roller gear 36. Referring to FIG. 2, a processor 54 is provided to receive and process data from the web sensor 32, the end sensor 34, and the encoder 52, the processor 54 being in communicative arrangement with the stepper motor 94, whereby the stepper motor 94 drives the differential drive unit 16 and is adapted to adjust the rotational movement of the anvil roller 48 and preferably the rotary cutting roller 38 to ensure proper placement of the predetermined die cutting configurations. A waste take-up spindle 29 is preferably provided for receiving laminated web material waste 22*c* after cutting (see FIG. 1).

Still referring to FIG. 1, an overdriven lower tension roller 58 and an upper nip roller 59 may be provided, the overdriven lower tension roller 58 and the upper nip roller 59 providing a nip 74 for receiving the cut, laminated web material 22*b*. The cut, laminated web material 22*b* is moved into the nip 74 formed between the overdriven lower tension roller 58 and the upper nip roller 59 whereby the overdriven lower tension roller 58 and the upper nip roller 59 provide a continuous tension on the web material 22*b* between the overdriven lower tension roller 58 and the upper nip roller 59 and the rotary cutting roller 38 and anvil roller 39. A take-up spindle 56 may then be provided for receiving a take-up spool, where the take-up spool is arranged to receive cut web material 22*b*.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

I claim:

1. An apparatus for die cutting comprising:

a rotary cutting roller having a first end surface and a second end surface, a circumferential surface, at least one indicia affixed to a predetermined location on the first end surface, and at least one cutting knife located on the circumferential surface, the cutting knife corresponding to a predetermined die cutting configuration, wherein the location of said at least one indicia on the first end surface corresponds to the number and circumferential placement of said at least one cutting knife;

at least one end sensor for detecting the at least one indicia on the first end surface, wherein said at least one end sensor is operable from a fixed location;

an anvil roller disposed in cooperating rotational movement with the rotary cutting roller to provide a nip, the nip being positioned for receiving a web material, whereby the web material is die cut in the predetermined die cutting configuration, the web material having pre-applied longitudinally spaced web indicia;

at least one web sensor for detecting the pre-applied longitudinally spaced web indicia on the web material;

an encoder for detecting rotational movement of the anvil roller; and a processor for receiving information from the end sensor, the web sensor, and the encoder, and translating this information for adjusting the rotational movement of the rotary cutting roller to thereby register said die cutting configuration on said web.

2. The apparatus of claim 1 wherein a laminating material is applied to the web material, and wherein the laminated web material, is die cut to the predetermined die cutting configuration.

3. The apparatus of claim 1 further including means for receiving laminating material, the means for receiving laminating material including a laminating supply roll spindle and a laminating material supported by the laminating supply roll spindle.

4. The laminating material of claim 3 further including a backing material.

5. The apparatus of claim 4 further including a laminating backing material take-up spindle.

6. The apparatus of claim 1 further including means for receiving laminating material, the means for receiving laminating material including a laminating supply roll spindle and an adhesive backed laminating material without backing material.

7. The apparatus of claim 1 wherein the web material includes a releasable liner material.

8. The apparatus of claim 7 wherein the cutting knife is configured to a height sufficient to cut the web material without cutting the releasable liner material.

9. The apparatus of claim 1 wherein the cutting knife extends radially from the circumferential surface to a predetermined height.

10. The apparatus of claim 1 further including drive means, the drive means communicating with the anvil roller and the rotary cutting roller.

11. The apparatus of claim 1 further including means for receiving spooled web material, the means for receiving spooled web material including a web feed spindle.

12. The apparatus of claim 1 further including means for receiving spooled web material, the means for receiving spooled web material including a web feed assembly.

13. The web feed assembly of claim 12 including a clutched roller and a wrap idler for web material tensioning, and an upper rocker roller and a lower rocker roller, the upper and lower rocker rollers for removing power to the apparatus when web material is no longer available.

14. The apparatus of claim 1 wherein the web material includes at least a first side and a second side, and at least one web indicia located on one of the first side and the second side.

15. The apparatus of claim 1 further including a take-up assembly, the take-up assembly including an overdriven lower tension roller and an upper nip roller for receiving the cut web material and for maintaining a continuous tension on the web material.

16. The take-up assembly of claim 15 further including drive means for controlling rotational movement of the overdriven lower tension roller.

17. The apparatus of claim 15 wherein the overdriven lower tension roller has a diameter larger than the anvil roller for maintaining a tension on the web material.

18. The overdriven lower tension roller of claim 15 further including a spring biasing means for controlling rotational slippage.

19. The apparatus of claim 1 further including an infeed and laminating assembly, the infeed and laminating assembly having a drive roller and a pressure roller for receiving web material and laminating material and applying the laminating material to the web material.

20. The infeed and laminating assembly of claim 19 further including drive means for controlling rotational movement of the drive roller.

21. The apparatus of claim 19 further including means for receiving laminating material, the means for receiving laminating material including a laminating supply roll spindle and a laminating material supported by the laminating supply roll spindle.

22. The laminating material of claim 21 further including a backing material.

23. The apparatus of claim 19 further including a laminating backing material take-up spindle.

24. The apparatus of claim 19 further including means for receiving laminating material, the means for receiving laminating material including a laminating supply roll spindle and an adhesive backed laminating material without backing material.

25. The apparatus of claim 1 further including a plurality of indicia affixed to a predetermined location on said first end surface.

26. An apparatus for die cutting comprising:

a rotary cutting roller having a first end surface and a second end surface, a circumferential surface, at least one indicia affixed to a predetermined location on the first end surface, and at least one cutting knife located on the circumferential surface, the cutting knife corresponding to a predetermined die cutting con figuration, wherein the location of said at least one indicia on the first end surface corresponds to the number and circumferential placement of said at least one cutting knife;

at least one end sensor for detecting the at least one indicia on the first end surface, wherein said at least one end sensor is operable from a fixed location;

an anvil roller disposed in cooperating rotational movement with the rotary cutting roller to provide a nip, the nip being positioned for receiving a web material, whereby the web material is die cut in the predetermined die cutting configuration, the web material having pre-applied longitudinally spaced web indicia;

at least one web sensor for detecting the pre-applied longitudinally spaced web indicia on the web material;

an encoder for detecting rotational movement of the anvil roller;

a processor for receiving information from the end sensor, the web sensor, and the encoder, and translating this information for adjusting the rotational movement of the rotary cutting roller to thereby register said die cutting configuration on said web;

an infeed and laminating assembly for receiving web material and laminating material and applying the laminating material to the web material;

a take-up assembly for receiving the laminated and cut web material and maintaining a continuous tension on the laminated and cut web material; and drive means for operating the apparatus.

27. The apparatus of claim 26 wherein a laminating material is applied to the web material, and wherein the laminated web material is die cut to the predetermined die cutting configuration.

28. The apparatus of claim 26 further including means for receiving laminating material, the means for receiving laminating material including a laminating supply roll spindle and a laminating material.

29. The laminating material of claim 28 further including a backing material.

30. The apparatus of claim 29 further including a laminating backing material take-up spindle.

31. The apparatus of claim 26 further including means for receiving laminating material, the means for receiving laminating material including a laminating supply roll spindle and an adhesive backed laminating material without backing material.

32. The apparatus of claim 26 wherein the web material includes a releasable liner material.

33. The apparatus of claim 32 wherein the cutting knife is configured to a height sufficient to cut the web material without cutting the releasable liner material.

34. The apparatus of claim 26 wherein the cutting knife extends radially from the circumferential surface to a predetermined height.

35. The apparatus of claim 26 further including means for receiving spooled web material, the means for receiving spooled web material including a web feed spindle.

36. The apparatus of claim 26 further including means for receiving spooled web material, the means for receiving spooled web material including a web feed assembly.

37. The web feed assembly of claim 36 including a clutched roller and a wrap idler for web material tensioning, and an upper rocker roller and a lower rocker roller, the upper and lower rocker rollers for removing power to the apparatus when web material is no longer available.

38. The apparatus of claim 26 wherein the web material includes at least a first side and a second side, and at least one web indicia located on one of the first side and the second side.

39. The apparatus of claim 26 further including a plurality of indicia affixed to a predetermined location on said first end surface.

* * * * *

UNITED STATES PATENT AND TRADEMARK OFFICE

CERTIFICATE OF CORRECTION

PATENT NO. : 7,661,344 B2
APPLICATION NO. : 10/902499
DATED : February 16, 2010
INVENTOR(S) : Wallace J. Beaudry It is certified that error appears in the above-identified patent and that said Letters Patent is hereby corrected as shown below:

Column 9, line 3 of claim 2, after "material" delete ",".

Column 10, line 7 of claim 26, after "die cutting" delete "con figuration" and substitute -- configuration --.

Signed and Sealed this
Nineteenth Day of February, 2013

Teresa Stanek Rea
*Acting Director of the United States Patent and Trademark Office*